United States Patent [19]

Girres

[11] 4,057,254

[45] Nov. 8, 1977

[54] APPARATUS FOR PLAYING A HORSE-RACING GAME

[75] Inventor: Gerard E. Girres, Great Falls, Mont.

[73] Assignee: The Raymond Lee Organization Inc., a part interest

[21] Appl. No.: 683,020

[22] Filed: May 4, 1976

[51] Int. Cl.[2] ..... A63F 3/00

[52] U.S. Cl. ..... 273/134 CH

[58] Field of Search ..... 273/86, 134

[56] References Cited

U.S. PATENT DOCUMENTS

| | | | |
|---|---|---|---|
| 866,447 | 9/1907 | Falkenberg | 273/134 AC |
| 1,522,048 | 1/1925 | Creed | 273/134 AC |
| 2,415,073 | 2/1947 | Buffmire | 273/134 GM UX |
| 3,057,623 | 10/1962 | Barnes | 273/134 CH UX |
| 3,912,273 | 10/1975 | Barlow | 273/134 CA |

FOREIGN PATENT DOCUMENTS

| | | | |
|---|---|---|---|
| 902,596 | 12/1944 | France | 273/134 CH |

*Primary Examiner*—Delbert B. Lowe

[57] ABSTRACT

A flat rectangular playing surface has a plurality of equidistantly spaced concentric slots cut into its surface. Playing pieces which are shaped like horses and riders are supported upon vertical standards that engage the slots and that allow the pieces to be moved along in the slots in such a fashion as to simulate a horse race.

1 Claim, 7 Drawing Figures

APPARATUS FOR PLAYING A HORSE-RACING GAME

SUMMARY OF THE INVENTION

The object of this invention is to provide apparatus which will enable a plurality of players to simulate a horse race and thereby play an exciting and enjoyable game.

Although the actual play of the game makes use of a disc, play money, various decks of cards and other props, the most important apparatus in the game consist of the playing board and the pieces that can be played on it. This board is horizontal, hollow, and rectangular in shape and the playing surface is emblazoned with various printed material suggestive of horse races. Into the playing surface are cut a family of concentric, equidistantly spaced slots that are formed into loops in the general shape of the periphery of a racetrack. Playing pieces, each having the shape of a horse and rider, are supported upon vertical standards that engage the slots at their lower ends. Thus, the playing pieces can be moved around in the slots to simulate a horse race.

DETAILED DESCRIPTION OF PREFERRED EMBODIMENTS

A playing board has a flat, rectangular base 10 and a flat, rectangular playing surface 20 located above and parallel to it. The board and surface are held together by a plurality of spaced vertical posts 30.

Figure 1:
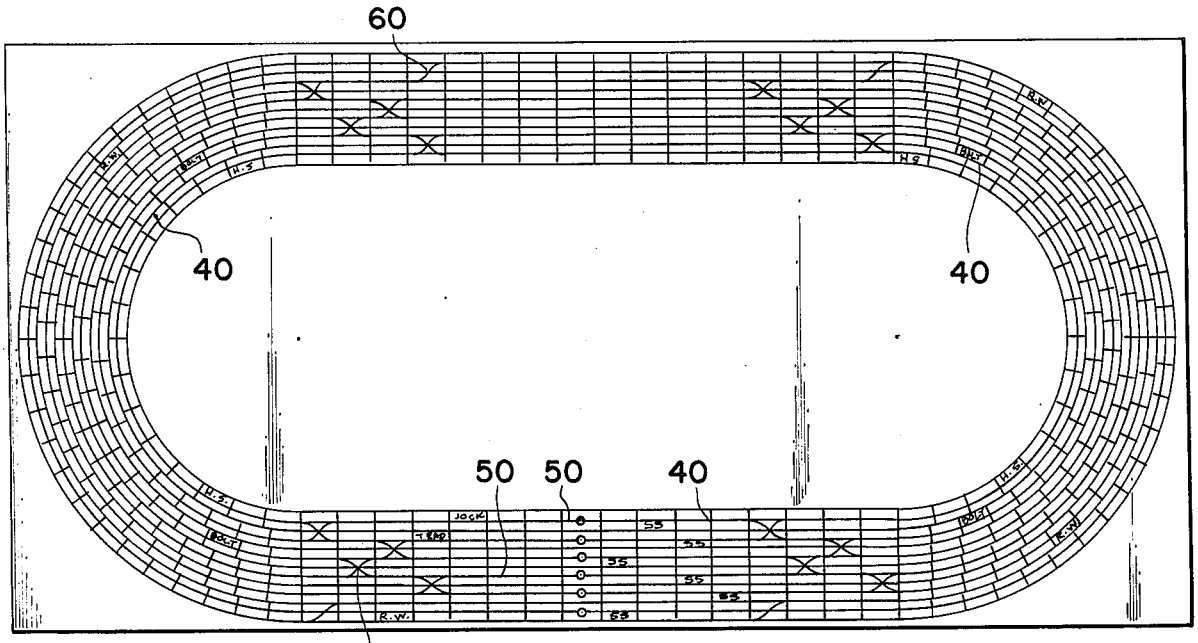
FIG. 1 is a top view of the playing board
Figure 2:
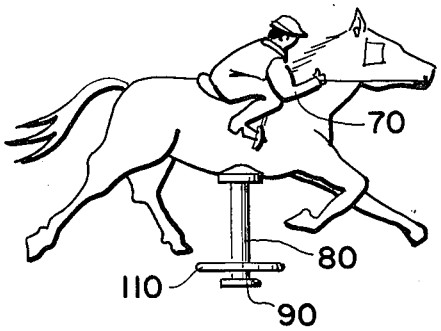
FIG. 2 shows a playing piece and its pedestal.
Figure 3:
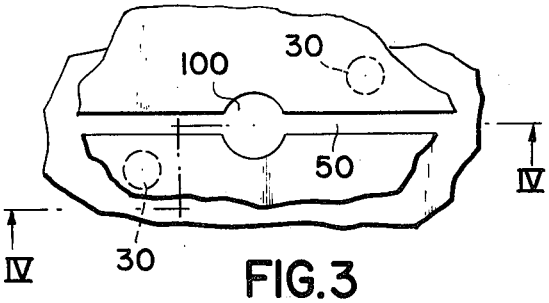
FIG. 3 shows one of the holes located along the slots in the playing surface.
Figure 5:
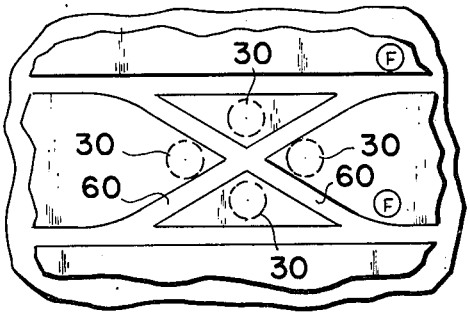
FIG. 5 shows the slots that connect two adjacent slots.
Figure 4:
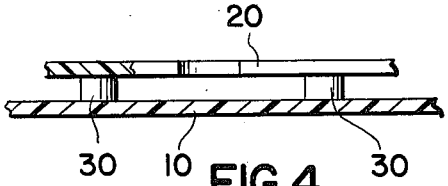
FIG. 4 is a view along line IV—IV of FIG. 3.
Figure 6:
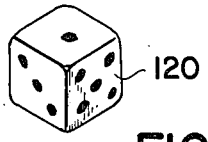
FIG. 6 shows a die used in the invention.
Figure 7:
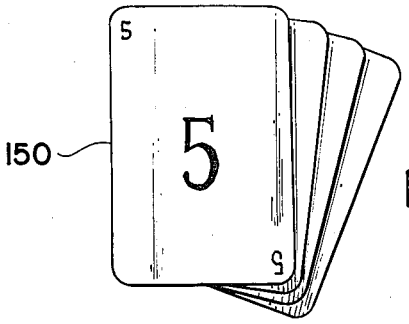
FIG. 7 shows a deck of playing cards used in the invention.

As can be seen in FIG. 1, the playing surface has printed indicia 40 symbolic of horse racing. Additionally, a plurality of slots 50 are cut into the playing surface. These slots form a family of concentric closed loops that are spaced equidistantly from each other and are all arranged in the shape of a racetrack.

It can be seen that slots 60 are cut between adjacent slots 50, to connect the latter together.

Pieces such as that shown at 70, in the shape of a horse and jockey, are mounted on top of vertically elongated pedestals 80. At the bottom of each pedestal is a small disc 90 that will fit into any of the plurality of holes 100 located in the slots at various points. Above the disc 90 is a player disc 110 that cannot fit through any of the holes. It can thus be seen that a playing piece, once introduced into one of the holes, can be moved along any one of the slots (or between slots, via one of the slots 60) without falling over. The piece can be removed when one of the holes is reached.

The game can be played by various sets of rules, depending upon the complexity of the game desired and the number of players. However, a die 120, a vertically oriented rectangular tote board supported on stands, two decks of cards 150, betting tickets, play money and a multi-compartmented play money tray and a preprinted program may be used if desired.

I claim:

1. Apparatus for playing a horse racing game comprising:

a horizontal rectangular base;

a rectangular playing surface located above the base and held parallel to it by a plurality of like vertical posts, the surface bearing printed and ruled indicia suggestive of the sport of horse racing and further bearing a plurality of slots arranged to form a concentric family of closed loops spaced equidistantly from each other in the shape of a horse racing track, each of the loops having a single circular hole therein, all of said holes being arranged in vertical alignment;

a plurality of playing pieces, each piece taking on the form of a horse and rider; and a like plurality of vertical standards, each standard being attached to the bottom of a corresponding piece and having a small circular disc located at its lowermost end and a larger circular disc located above the small disc with the small discs being at most equal in size to the holes and the larger disc being larger than the holes so as to allow the standards to be introduced into the slots and removed therefrom only at those points along the slots where the holes are located.

* * * * *